United States Patent [19]

Gray

[11] Patent Number: 4,990,896

[45] Date of Patent: Feb. 5, 1991

[54] LIGHT RESPONSIVE DEVICE FOR MONITORING ON-LINE INDICATOR LIGHTS

[76] Inventor: William F. Gray, 1212 Ingleside Ave., McLean, Va. 22101

[21] Appl. No.: 349,482

[22] Filed: May 9, 1989

[51] Int. Cl.[5] ..... G08B 21/00

[52] U.S. Cl. ..... 340/641; 250/551; 250/215; 340/693; 379/164; 200/61.02

[58] Field of Search ..... 340/641, 458, 600, 638, 340/642, 691, 693, 825.17, 825.16, 506; 324/501; 200/61.02; 250/551, 215; 379/164, 196; 73/DIG.11; 357/19; 307/117

[56] References Cited

U.S. PATENT DOCUMENTS

| | | | |
|---|---|---|---|
| 3,665,111 | 5/1972 | Schieser | 250/215 |
| 4,028,502 | 6/1977 | Moricca et al. | 379/164 |
| 4,063,044 | 12/1977 | Stephan | 379/164 |
| 4,268,113 | 5/1981 | Noel, Jr. | 250/551 |
| 4,354,115 | 10/1982 | Warabisako et al. | 250/551 |
| 4,481,423 | 11/1984 | Conway | 250/551 |
| 4,634,877 | 1/1987 | Wills | 250/551 |
| 4,636,647 | 1/1987 | Nishizawa | 250/551 |
| 4,901,099 | 2/1990 | Sakamoto et al. | 200/61.02 |

FOREIGN PATENT DOCUMENTS

| | | | |
|---|---|---|---|
| 2753548 | 6/1979 | Fed. Rep. of Germany | 250/551 |

OTHER PUBLICATIONS

News Release "Red-Eye Optical Console Monitor", 2/89, TeleMonitor Corp.

*Primary Examiner*—Joseph A. Orsino
*Assistant Examiner*—J. Jackson
*Attorney, Agent, or Firm*—Leydig, Voit & Mayer

[57] ABSTRACT

A photovoltaic device is provided that is adapted to monitor an "on-line" light source and respond to on/off changes of the source while at the same time being adapted for visual inspection of the light. The device is adapted for incorporation into a remote warning system which may also be able to activate remedial measures to correct deviations signalled by a change in the "on-line" light status.

35 Claims, 2 Drawing Sheets

LIGHT RESPONSIVE DEVICE FOR MONITORING ON-LINE INDICATOR LIGHTS

TECHNICAL FIELD

The present invention relates to a light sensing device and specifically to a device adapted to monitor on-line indicator lights in, for example, electronic equipment without requiring any electrical or permanent mechanical interface with the system to be monitored.

BACKGROUND OF THE INVENTION

With many items of complex modern electronic equipment, it is not readily possible to determine if all components of the equipment are functioning correctly and, if not, which component is the source of the problem. For this reason, it is commonplace to provide, for each major component, an indicator light that either lights to show that an intermittently activated component is "on-line", or functioning properly, or alternatively lights to show that a component is no longer functioning (for whatever reason).

Indicator lights of this kind can be found in addition in other less complex situations such as lights to show a room is occupied or lights to indicate that an item has passed a test. For the sake of simplicity, all status-indicating lights will be referred to hereinafter as "on-line" lights regardless of the function involved. The most significant applications of the present invention are, however, in the field of the monitoring of electronic equipment.

It is known to have a malfunction warning system built into the equipment but, since these run off the same power source, a catastrophic failure also shuts down the warning system. In addition, it is very difficult to retrofit an existing system with such warning systems without violating the electrical integrity of the existing system. In addition, there are physical problems in retrofitting a system that is complex and very compact.

Another problem is that the monitoring function cannot always be performed by a human operator especially where the number of components to be monitored is great, or if the location to be monitored is remote. It can often happen, therefore, that a malfunction can go undetected for a prolonged period, perhaps leading to a chain of failures of far greater significance than the original. In addition, remote trouble-shooting and corrective measures that are now available are of reduced utility unless means are provided for quickly identifying the need for such measures. The present invention supplies this need in a most efficient and flexible manner, i.e., in a manner that is readily adaptable to a wide range of preexisting systems.

DESCRIPTION OF THE INVENTION

It is an object of the present invention to provide a device for the remote monitoring of an on-line light that is readily attached, detached, and moved, is extremely effective, and requires no electrical interface with the system being monitored. It is also an object to provide a monitoring device that does not require modification of the monitored equipment by provision of brackets, screw holes, and the like, nor occupy often scarce internal space. It is a further object to provide devices that are relatively cheap and easily installed.

Another object is to provide a device that can activate a signal at a remote location upon a change in the on/off status of an on-line light, thus providing an operator alert that is not readily available from visual inspection. This is particularly useful in "lights-out" or "dark" equipment locations, that is, locations where the equipment is visually inspected only at long intervals.

The present invention, therefore provides a device responsive to an on-line light comprising:

a housing having first and second surfaces and a light access port in the first surface communicating with the recess within the housing;

a photovoltaic device located within said recess;

means for releasably adhering the housing to a surface surrounding an on-line light in a fashion that permits no significant access of ambient light through the light access port where the device is adhered to such a surface; and an inspection port for visually monitoring the on/off status of said light.

In normal use the on-line light is set in a panel and the device of the invention is adhered to the panel around the light such that light shines onto the photovoltaic cell in the recess within the housing, thereby generating an electric current. Because the intensity of the usual on-line light tends to be low, it is necessary to prevent a significant proportion of all ambient light from reaching the photovoltaic cell through the light access port to ensure that the light status change is properly registered. Otherwise expressed, it is necessary that the panel/device connection is essentially light-tight.

A preferred way of achieving such a light-tight connection is to provide that the surface of the device having the light access port be provided with a contact adhesive coating so that the surface can be releasably adhered by the adhesive to the panel with the on-line light in register with the port. The contact adhesive is most suitably provided by a double-sided adhesive strip that, in use, adheres to the surface of the housing in which the light access port is located and to the panel. The exposed surface of the adhesive strip can be covered by a release paper when the device is not in use.

When such a double-sided adhesive tape is used it is preferred that the adhesiveness of one side be significantly greater than that of the other. In this way, removal of a device from a monitoring site will not leave the double-sided tape adhered to the surface because the tighter bond is with the device itself and the weaker is with the surface of the monitored device.

The housing is also provided with an observation port so that the on-line light can be visually monitored while the device is still in place. It is, however, necessary to ensure that any light entering through the observation port does not interfere with the operation of the device. This can conveniently be done by screen-printing an optical surface covering the observation port to limit access of light therethrough. An alternative and often a preferred embodiment is to provide that observation of the on/ off status of an on-line light is by way of a passage having upper and lower observation ports, the lower observation port being adjacent but separate from the light access port. In this way there is no direct path for ambient light entering the upper observation port to reach the photovoltaic device. In addition, it is often advantageous to provide that the interior surfaces of the recess and any passages communicating between the recess and the observation port and/or the light access port have a nonreflective matte black finish. The effect of this is to minimize the amount of internally reflected light reaching the photovoltaic device after entering by way of the observation port.

It is often preferred that the observation port be covered by a transparent, colored light filter of the color of the on-line light, which is usually red.

The photovoltaic device generates an electric current in proportion to the intensity of the light contacting it. This current is carried on a wire connection exiting the housing by means of a wire port and connecting the device to a monitor. Another aspect of the invention, therefore, is a device as described above electrically connected to a remote monitor. This monitor can be adjusted to respond only to light intensity changes of a certain magnitude. In some monitors, this magnitude can be remotely changed according to current needs. The monitor itself, in its simplest form, activates an appropriate warning to a human observer. In more sophisticated versions, the monitor itself evaluates the situation and initiates an appropriate series of appropriate actions in response. These might be a change in a setting of an interactive machine, or the start of a diagnostic sequence of testing, or the start-up of a backup machine and so on.

The device can be made out of any nontranslucent material or a translucent material made opaque by an external coating of a nontransparent material such as black paint.

In a preferred device the housing is manufactured from a flexible polymeric foam material. The housing may in fact be made by laminating a plurality of layers of such foam having similar dimensions, with an aperture centrally located in each to provide a recess communicating with light access and observation ports on opposed faces. The light access port-containing face is preferably provided with a double-sided adhesive layer that may have a removable contact paper covering the exposed face. The light access port may optionally be provided with a convex lens to focus light from the monitored device onto the photovoltaic device. This is desirable if the intensity of this light is relatively low.

The means for releasably adhering the device can be provided by an adhesive applied to the face of the device bearing the light access port. It is, however, often preferred to use a double sided adhesive tape with one side adhered to the housing and the other intended to adhere the device to a surface surrounding a light to be monitored. The tape may be of a resilient foam material with an appropriate hole to permit light to reach the light access port. This is a desirable option if the light to be monitored protrudes a little above the surface in which it is located since it can then be accommodated within the hole in the tape.

Alternatively and often preferably, it is a clear tape made, for example, of an acetate, polyolefin, or polyvinyl chloride (PVC) film.

The housing can however also be machined or molded from a rigid plastic or metal provided with an adhesive layer so as to offer an essentially light-tight connection with a panel surrounding a light source that is to be monitored. The preferred material is a plastic that is electrically non-conductive, such as PVC.

The observation port which permits direct visual monitoring of the on-line light is preferably configured so as to limit the access of ambient light to the recess containing the photovoltaic device and this can be by ensuring no direct light communication between the observation port and the photovoltaic device. Alternatively, light access through this port can be artificially restricted, for example, by screen printing or color filtering.

It is often desirable to provide a convex lens over the observation port such that the on/off status of the on-line light can be monitored from the side, i.e., without needing to look directly down through the observation port. Care needs to be taken, however, where the ambient light has a relatively high intensity and the observation port communicates directly with the aperture containing the photovoltaic device since the lens can act to concentrate the effect of the ambient light and diminish the sensitivity of the device to changes in the monitored on-line light.

The light source itself is commonly a light emitting diode (LED) but this is not essential. The LED can, for example, be replaced by any on/off console light display such as a low voltage direct current bulb. Such alternatives, however, are not generally preferred.

DESCRIPTION OF PREFERRED EMBODIMENTS

The invention is now described with particular reference to the attached drawings. It is to be understood, however, that such drawings are provided for the purposes of exemplification only and are intended to imply no essential limitation on the full scope of the invention.

Figure 1:
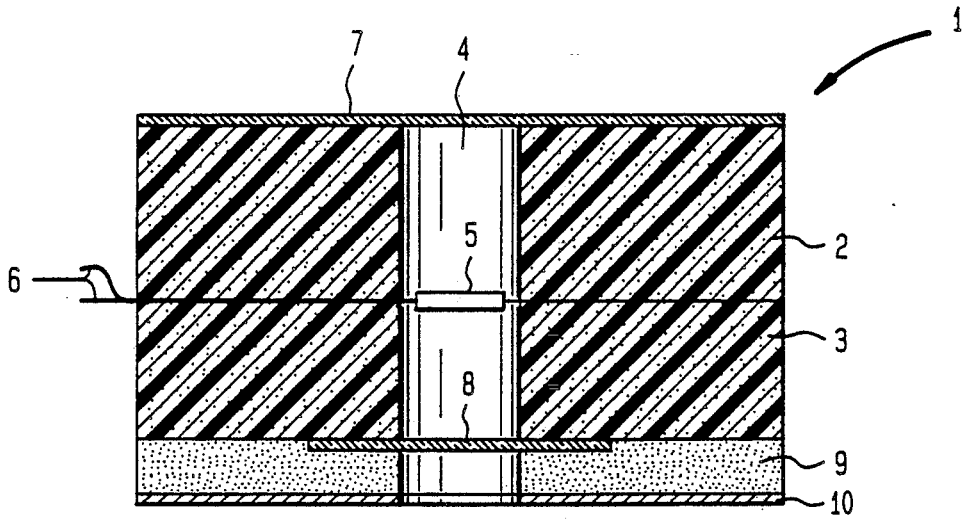
FIG. 1 is a cross-section of a device according to the invention.

In FIG. 1, a device is provided comprising a housing 1 in two parts, 2 and 3. These parts are matched squares of a polyurethane foam each having a centrally located hole 4 which together provide the recess in which a photovoltaic device 5 with connecting wires 6 is disposed. One end of the recess provides the observation port and a clear colored plastic screen 7, overprinted with a pattern so as to limit the access of light through that screen, is provided to close off the recess at that end. The screen is colored to augment the color of the light source. A transparent plastic cover 8 closes the opposed end of the recess which corresponds to the light access port. A double-sided adhesive strip 9 with a central aperture of the same size as the recess in the housing member is adhered to the exposed face of housing member 2. This also assists in locating the cover 8 in place over the light access port. The exposed face of the double-sided adhesive strip is provided with a removable release paper cover 10 to protect the adhesive surface.

The device is used to monitor an on-line light on a panel. To do this, the release paper cover of the adhesive layer is removed and the device is pressed onto the panel such that the on-line light projects into the recess of the device. Light from the on-line light activates the photovoltaic device 5 and generates a current that is transmitted along wires 6 to a suitable receiver/detector. The patterned and/or colored screen 7 limits the access of light from the surroundings through the observation port and the bond between the adhesive strip and the panel substantially prevents ambient light entering through the light access port. Since the amount of current generated by the photovoltaic device varies with the intensity of the light received, the on/off status of the indicator light can be readily determined by following changes in the current reading.

FIG. 1 illustrates a very simple and cheap version of the device of the invention. As can readily be appreciated, it can be easily manufactured and readily applied and removed while at the same time providing a sensitive and accurate indication of the on/off status of the light.

To limit further the access of ambient light through the patterned screen 7, it is possible to apply to the exposed surface of the housing member 2 a removable cover, for example, a strip of black adhesive tape, which can be left in place on top if there is no need to monitor visually the on/off status of the indicator light.

The foam material can be unitary, or built up from a number of layers of foam with adhesive applied to each side, in which case the bottom layer, having the aperture providing the light access port itself, provides the means for adhering the device to the surface and the clear plastic screen over the observation port extends over the whole of that surface and is adhered by means of the adhesive on that surface.

The foam itself may be of any suitable resilient material such as a polyurethane, polyvinyl chloride, an olefin polymer (such as polyethylene), a copolymer (such as ethylene/vinyl acetate), polybutadiene, polyisoprene, and other such natural or synthetic rubbers and the like.

As may readily be appreciated, where the device is located in a "lights out" or "dark" site, it may be possible to dispense with the observation port altogether and this may be done in one embodiment of the invention. The devices of the invention having a configuration similar to that shown in FIG. 1 are particularly adapted for monitoring equipment during testing and other limited periods.

The devices can be supplied in the form of a roll or a pack in which the devices are arranged in side-by-side relationship perhaps in the form of a roll of a continuous foam strip from which individual units or groups of units are removed as needed by cutting or by tearing at perforations between adjacent units. An alternative embodiment provides separate devices adhered side-by-side on a continuous, optionally perforated, release paper. This can then be rolled into a reel or folded back and forth to provide a flat pack. With such a pack, the user merely rips off a device for immediate installation on a surface.

The embodiments described with relation to FIG. 1 are ideal for mounting on irregular surfaces since the resilient, rubber-like foam is moldable and conforms itself to the irregularities. Because they use "bore sight" installation, that is, the light source is sighted directly through the observation port, they can be positioned very accurately to secure maximum access of the source light to the photovoltaic device. Finally, because the devices can be made very thin, they can be used where only a small vertical clearance space is available.

Figure 2:
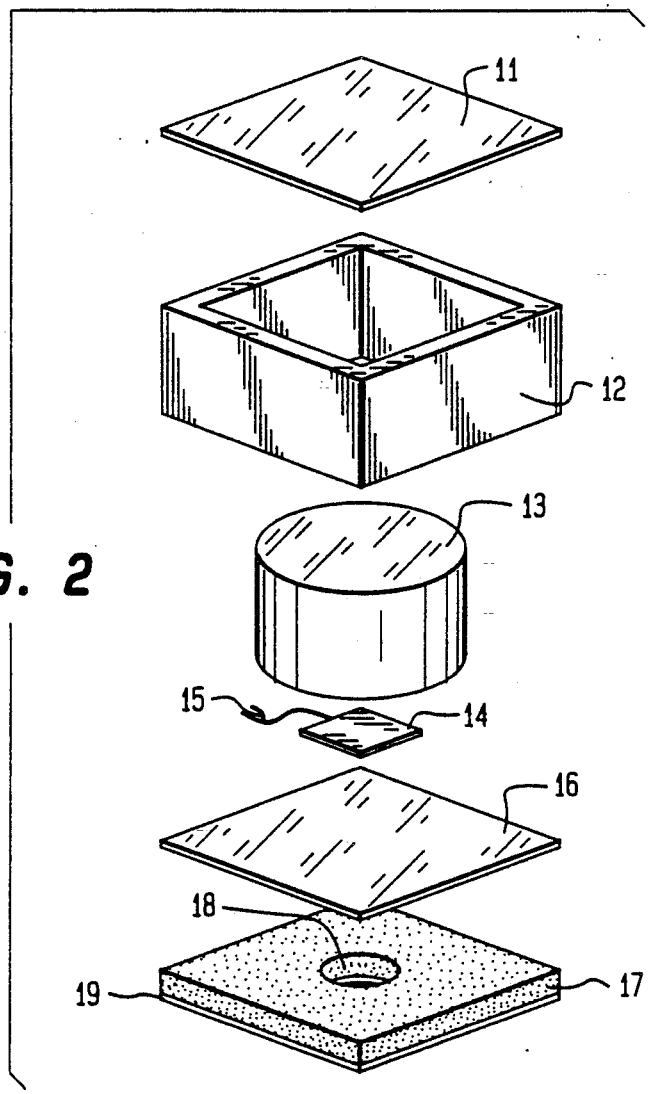
FIG. 2 is an exploded side perspective view of another embodiment of a device according to the invention.

The embodiment of the device illustrated in FIG. 2 comprises a clear top cover 11 adhered to a square tube 12. A cylindrical clear plastic bar 13 having a diameter slightly less than the length of an internal side of the square tube and a length slightly less than the tube length is fitted into the square tube 12 and adhered to the clear top cover 11 so as to leave a small recess to accommodate a photovoltaic device 14 with leads 15. A clear bottom cover 16 is adhered to the opposed end of the square tube 12 so as to seal the photovoltaic device 14 and the clear plastic bar 13 inside the square tube 12. One end of the bar 13, covered by the clear top cover 11, forms the observation port. The exposed face of the clear bottom cover 16 is adhered to a double-sided adhesive strip 17 having a central aperture 18 corresponding in location to the location of the photovoltaic device 14 within the device. The exposed face of the double-sided adhesive strip may be protected by a removable release paper 19. To minimize the access of ambient light through the clear top cover 11, the interior surfaces of the square tube 12 and the external cylindrical surface of the bar 13 are painted a dull matte black finish. Alternatively, of course, the square tube can be fabricated from an opaque, preferably black, plastic rather than having its interior surfaces painted black. In addition, a masking tape may be applied to the exposed surface of the cover 11 or, alternatively, a pattern may be applied to the clear top cover 11 so as to limit the light that can access the interior of the device through the observation port in the clear top cover 11. In addition, the surface of the clear bottom cover 16 which is adhered to the square tube 12 may also be painted a dull matte black finish except for a central port (the light access port) which is left clear to allow access of light from the on-line indicator light.

This device operates in exactly the same way as was described in relation to the device of FIG. 1. The release paper on the double-sided adhesive strip 17 is removed and the device is adhered to a panel surrounding an on-line indicator light. When the light is on, the photovoltaic device 14 is activated generating a signal conducted to a monitoring station through leads 15. In addition, the on/off status of the light can be monitored through the observation port in the clear top cover 11.

In a series of tests, a device according to FIG. 2 was applied to an LED mounted on an instrument panel and was monitored. The photovoltaic device was a VTP silicon photodiode supplied by EG&G Vactec. The test was conducted in a room with a ceiling light and the voltage across the photodiode, in what was, in effect, an open circuit, was measured using a conventional voltmeter. It should be noted that the voltage generated in such a system bears a logarithmic relation to the light intensity. The following Table 1 illustrates the voltage recorded on a voltmeter attached to leads 15. In Table 1, the first column indicates whether the observation port in its clear top cover 11 was covered or not; the second column indicates whether the LED light was on or off; the third column indicates whether the ceiling light in the room was on or off; and the fourth column records the voltage reading.

TABLE 1

| Observation Port Covered? | LED On/Off | Voltage Reading Ceiling Light Off | Voltage Reading Ceiling Light On |
|---|---|---|---|
| Yes | On | 0.414 v | 0.414 v |
| Yes | Off | 0.013 v | 0.106 v |
| No | On | 0.413 v | 0.413 v |
| No | Off | 0.024 v | 0.209 v |

As can be seen from the above table, the voltage reading obtained with the LED light on and the ceiling light on was virtually unchanged whether or not the observation port was covered. However, when the observation port was covered, the voltage generated by access of ambient light was almost twice as much when the ceiling light was on. Also when the ceiling light was off, the LED "on" voltage reading remained constant regardless of the port covering, while the LED "off" voltage approached zero as the ambient light was reduced. Thus, the LED "on" voltage is a reference voltage indicating LED "on", and any voltage significantly below that reference voltage indicates LED "off" at varying conditions of ambient light. Therefore, the monitoring system can be programmed with an LED Off/On voltage threshold slightly less than the "LED on" voltage (e.g., in Table 1 a threshold voltage of 0.380 volts might be appropriate).

Devices of the kind illustrated in FIG. 2 are very suitable for permanent installation at "lights-out" locations. The provision of a lens over the observation port to provide side view monitoring of the on/off status is a particularly suitable option in such situations.

The use of a clear double sided adhesive tape in the device of FIG. 2 would permit the elimination of the clear bottom cover 16 and, where measures are taken to eliminate access of ambient light, also the double sided adhesive tape 17. This is often a preferred feature, especially where the light to be monitored sits flank with or recessed into a surrounding surface.

Figure 3:
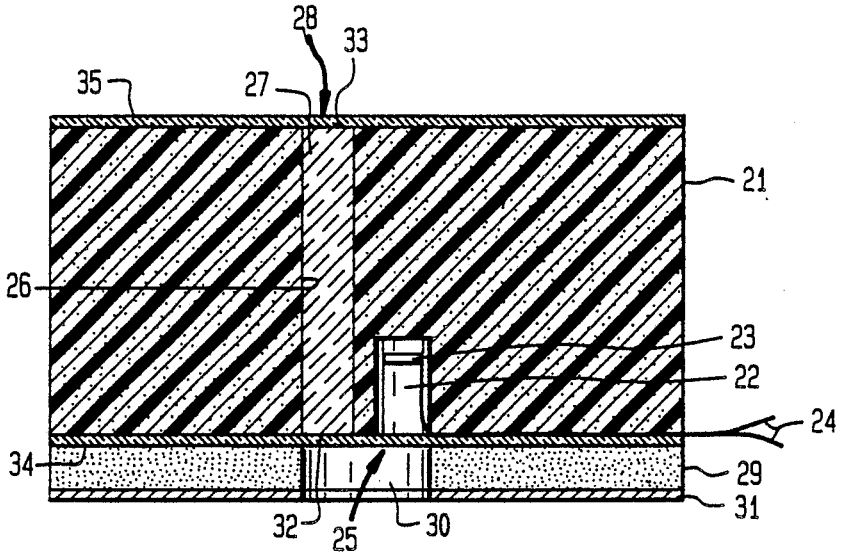
FIG. 3 is a cross-section of yet another embodiment of the invention.
Figure 4:
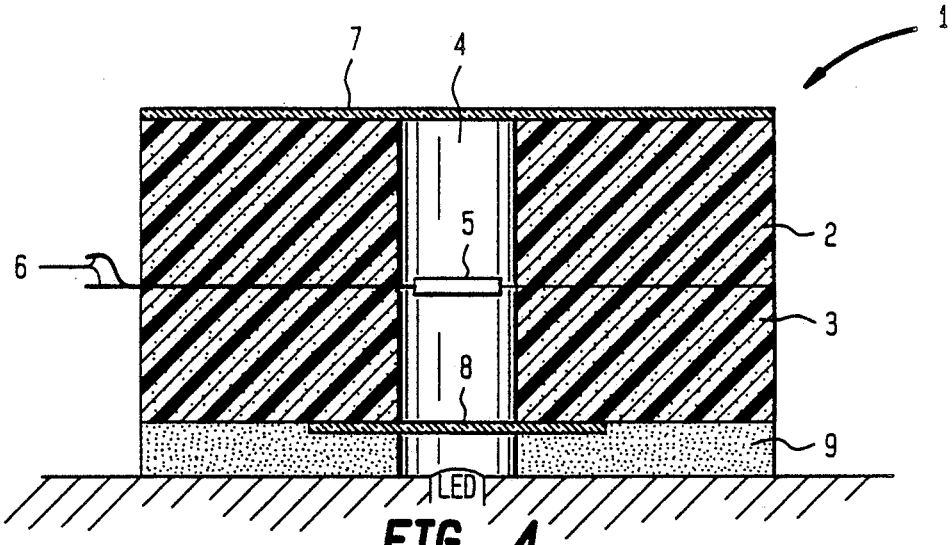
FIG. 4 is the device illustrated in FIG. 1 located in place on a panel surrounding an LED on-line light.

FIG. 3 describes a third embodiment of the invention which comprises a square block 21 of black polyvinyl chloride. A hole 22 is drilled in the block 21 in a centrally located position to a depth of about ½ the thickness of the block 21. At the base of this hole is located a photovoltaic device 23 with electrical leads 24. The open end of the hole provides the light access port 25. Adjacent the light access port 25 is drilled a second hole 26 which passes completely through the thickness of the block 21. This hole is filled by a rod of clear polyvinyl chloride (PVC) 27 having first and second ends, 32 and 33, respectively. The rod can, of course, be replaced by a bundle of optical fibers which may then be angled upon exiting the observation port to permit side or other more convenient angled viewing of the on/off status of a monitored light. The second end 33 of the rod is located at the face of the block 21 opposed to that bearing the light access port 25 and provides the observation port 28. The surface of the block 21 bearing the light access port 25 is covered by a first clear cover 34 and the opposed surface is covered by a second clear cover 35. These covers serve to retain the rod 27 in position and to protect the photovoltaic device 23. Alternatively and often preferably, the rod 27 is a press fit in the housing and this permits the elimination of the second clear cover 35. To the first clear cover 34 is adhered a double-sided adhesive strip 29 having a central hole 30 that is large enough to expose the light access port 25 and also the first end 32 of the clear PVC rod 27. A detachable release paper 31 covers the exposed adhesive surface of the double-sided adhesive strip 29. As with the embodiment of FIG. 2, the double-sided adhesive strip can be transparent and this permits the elimination of the first clear cover 34. This is often a preferred variation.

In use, the release paper 31 is removed and the device is placed over the on-line light to be monitored. The first end 32 of the clear PVC rod 27 and the light access port 25 are located sufficiently close together that the on-line light shines directly into both. Direct access of ambient light from the observation port 28 to the photovoltaic device 24 therefore is restricted and yet the on/off status of the light can be readily monitored visually.

It is also possible to adhere a lens onto the end of the clear plastic rod 27 that provides the observation port so as to permit side angle monitoring. In this embodiment, there is no problem with the possible increase of access of ambient light (as in the embodiment of FIG. 2) since there is no light communication between the rod and the recess containing the photovoltaic device.

It is also possible to incorporate a light intensifying convex lens within the recess between the photovoltaic device and the light access port.

The devices of the kind described with relation to FIG. 3 are particularly adapted for use in the permanent monitoring of equipment in brightly lit rooms. This is because visual monitoring is possible without risking an excessive access of ambient light to the device as a result of the use of the clear plastic rod 27 that does not communicate with the recess within the housing containing the photovoltaic device.

The devices described above are capable of a wide range of variations without departing from the essential purview of the invention. For example, where the on-line light to be monitored protrudes significantly from a panel in which it is located, it is possible to use a plurality of layers of double-sided adhesive strip with aligned holes such that the on-line light can be accommodated within said aligned holes and the exposed double-sided adhesive strip can be readily adhered to the panel in which the light is located. In addition, as can be seen, a variety of materials can be used to provide the housing for the photovoltaic device. However, all the preferred devices have the common feature of a light access port, an observation port, and a surface which can be adhered to a panel surrounding an on-line light.

Because the amount of ambient light can vary from time to time and because there can be variations in the intensity of the light from an on-line light, it is important that the response mechanism only be activated when the change in voltage exceeds a certain predetermined amount. This predetermined amount will be dependent on the experienced variation in recorded voltage under constant "light-off" conditions. In such cases, it is common to split the difference between measured normal and abnormal readings in order to get a threshold that must be exceeded before the monitoring device triggers its response.

The invention has been described in terms of photovoltaic devices, that is, devices which generate electricity in response to light. However, in principle the invention could be adapted for use with a photoresistor, which changes resistance in accordance with the amount of light to which it is exposed. In such a device, the resistance to a current flowing through the device is monitored and correlated with the amount of light to which the device was exposed and thus the on/off status of the light. The preferred photovoltaic devices are, however, photodiodes, particularly silicon photodiodes, which are widely available from a variety of sources such as EG&G Vactec.

The device of the present invention has a multiplicity of uses. It can be used in controlled environment locations such as storage vaults, art galleries, ultra-clean work places, and so on, which are monitored remotely for temperature and humidity. In such an application, departure from nominal conditions might be caused to activate a light which would be picked up by the device of the invention with an appropriate message relayed to a monitor. The response of the monitor could then be either activation of an alarm or corrective measures to change the humidity, temperature, etc., to a level within the nominal range.

The device of the subject invention can also be used to monitor smoke alarms, telephone systems, power systems, remote eyes, environmental control equipment, and so forth.

Figure 5:
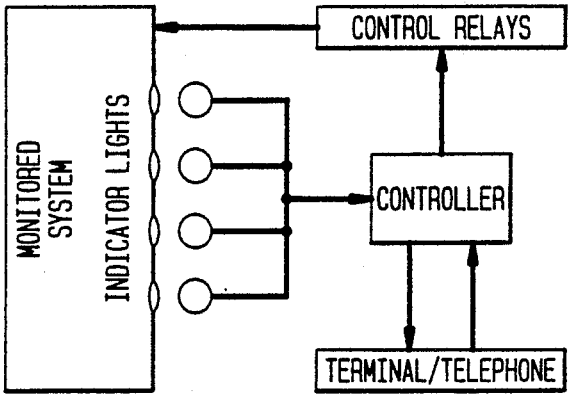
FIG. 5 is a diagram of a system incorporating a device according to the invention.

A simple model system incorporating the device of the invention is illustrated in FIG. 5. In the diagram, optical sensors are pressed on over console lights, LEDs, or other light emitting status indicators using the double-sided adhesive strip on the device. An embedded photodiode in the device generates a lower DC voltage when the console light is out and a higher voltage when the light is on. This voltage is transmitted to the controller. The controller scans and collects the inputs from the optical sensors. It uses the inputs to generate alarms and to operate equipment under programmed control. The controller can perform the following functions following parameters down-line loaded from a terminal:

(1) Calibration. The voltage ranges which signify the light on and off may be adjusted to accommodate changes in ambient light conditions.

(2) Diagnostics. The actual voltage is available through any terminal. Abnormally high and low voltages indicate trouble.

(3) Sensitivity. The period a light is continuously on before it is counted as on is adjustable.

(4) On/off. Readings from the sensor may be logically disconnected when they are no longer needed remotely.

(5) Autocontrol. The light signal may be used to activate a relay or to perform other automatic functions.

(6) Alarm. The light signal may be used to call other people for alarm.

In the system illustrated, a telephone link is activated when one of the sensors indicates a situation identified by the controller as abnormal after comparison with parameters established as above. The recipient of the telephone call may then activate control relays through the controller system which respond to the abnormal situation indicated by the optical sensor.

As will be appreciated, the light sensitive devices of the invention fit well into a system such as the above. They are as easy to install as a postage stamp. They can be installed on any computer console, equipment control panel, modem status display, printed circuit LED display, etc., without requiring technical skill, without compromising the electrical integrity of the monitored equipment, without impeding the equipment operation, without compromising the manufacturers warranty of equipment performance, without blocking visual console observation, and without requiring a source of electrical power.

The device of the invention is particularly adapted for use with the monitoring system described and claimed in U.S. Pat. No. 4,748,654, the contents of which are incorporated herein by reference.

I claim:

1. A light-responsive device comprising:

a housing having first and second surfaces and a light access port in the first surface communicating with a recess within the housing;

a photovoltaic device located within said recess;

adhesive on said first surface of said housing to attached said housing to a receiving surface surrounding a light source, a light-tight connection being established between said first surface and said receiving surface when said housing is so attached;

said housing providing a substantially opaque enclosure that permits no significant access of ambient light to the photovoltaic device through said housing when the housing is attached to such a receiving an observation port in said housing for visually monitoring on/off status of said light source.

2. A light-responsive device according to claim 1 in which means are provided to limit access of ambient light through the observation port to the photovoltaic device.

3. A light-responsive device according to claim 1 in which said housing defining the recess has interior surfaces which interior surfaces are provided with a nonreflective matte black coating so as to limit access of ambient light to the photovoltaic device.

4. A light-responsive device according to claim 1 in which the photovoltaic device is a photodiode.

5. A light-responsive device according to claim 1 in which a filter is provided over the observation port to further limit access of ambient light to the photovoltaic device.

6. A light-responsive device according to claim 1 in which the observation port is provided with a convex lens so as to permit side angle monitoring of the on/off status of a light monitored by such device.

7. A light-responsive device according to claim 1 in which the housing comprises a block of a plastic material having said internal recess communicating with said light access port in said first surface of the housing such that light can pass through the port and enter the recess.

8. A light-responsive device according to claim 7 in which the plastic material is an opaque plastic.

9. A light-responsive device according to claim 7 in which the plastic material is a clear plastic with surfaces treated with an opaque nonreflecting material so as to limit access of ambient light to the recess other than through the light access port.

10. A light-responsive device according to claim 1 in which the observation port communicates directly with an aperture adjacent to, but separate from, the light access port.

11. A light-responsive device according to claim 1 further including a removable release strip covering said adhesive which allows handling of the device and which is removable to expose said adhesive and permit it to be used to attach the device to such a surface.

12. A light-responsive device according to claim 1 in which light from the source to be monitored by the device travels to the observation port through a light-conducting rod of clear plastic.

13. A light-responsive device according to claim 12 in which the light-conducting rod has its external lengthwise surface treated with a nonreflecting opaque substance.

14. A monitoring system which comprises:

the light-responsive device according to claim 1 for registering activation or deactivation of the light source by a change of the voltage output of said photovoltaic device; and means for detecting said voltage output change.

15. A monitoring system according to claim 14 which further comprises means for responding in a predetermined manner to said change.

16. A light-responsive device according to claim 1 in which said housing is made from a moldable, rubber-like material which conforms to irregularities in the receiving surface and thereby facilitates the light-tight connection.

17. A light-responsive device according to claim 16 in which the housing is made from a plurality of laminae of a resilient foam material adhered together to form a block.

18. A light-responsive device according to claim 16 wherein the moldable rubber-like housing material may be cut to fit about the light source and to conform to the receiving surface.

19. An elongated strip formed of a plurality of light-responsive devices according to claim 16 joined in side-by-side relationship.

20. An elongated strip according to claim 19 in which separation means are provided between adjacent devices.

21. An elongated strip according to claim 20 in which the separation means is a series of perforations in a release paper covering the second surfaces of the housings.

22. A light responsive device comprising:

(a) a housing fabricated from a black plastic member and having first and second surfaces; an internal recess communicating with a light access port in the first surface; and a clear, plastic rod disposed within a hole in said housing, the hole being adjacent the recess and traversing said housing and ending in an upper observation port in said second surface and in a lower observation port in said first surface, the upper observation port in the second surface being connected with the lower observation port in the first surface through a light path including the clear plastic rod;

(b) a photovoltaic device located in the recess within the housing and responsive to light, from a light source surrounded by a receiving surface, reaching it through the light access port, generating an electric current proportional to the light intensity, said black plastic housing member providing a substantially opaque enclosure that permits no significant access of ambient light to the photovoltaic device through said housing when the housing is attached to said receiving surface;

(c) leads for conducting said current from the photovoltaic device; and (d) a double-sided adhesive, clear, plastic strip adhered to the first surface of the housing providing adhesive to attach the housing to the receiving surface.

23. A monitoring system which comprises:

the light-responsive device according to claim 22 for registering activation or deactivation of the light source by a change in voltage output of said photovoltaic device;

means connected to said leads for detecting said voltage output change; and means for responding in a predetermined manner to said change.

24. A monitoring system including said light-responsive device according to claim 22 and a controller device connected to said leads which compares a signal from said light-responsive device with a predetermined normal signal range and, in the event of a deviation from said normal range, activates a telephone warning to an operator and control relays in response to said deviation.

25. A light-responsive device comprising:

(a) a housing comprising a square plastic tube having first and second ends and, located inside said tube, a clear cylindrical plastic rod having a diameter slightly smaller than an internal side dimension of the square tube, and a length slightly less than the square tube, the first end of the tube being closed by a first transparent cover adhered to both the end of the square tube and the end of the adjacent rod, and the second end of the tube being covered by a clear, plastic double-sided adhesive strip adhered to the second end of the square tube, the cylindrical surface of the rod and the internal surface of the square tube being painted a nonreflecting matte black;

(b) a photovoltaic device located in a recess within the tube between the end of the rod and the clear plastic strip, said device being responsive to the light, from a light source, reaching it and generating an electric current proportional to the light intensity; and (c) leads for conducting said current from the photovoltaic device.

26. A monitoring system which comprises:

the light-responsive device according to claim 25 for registering activation or deactivation of the light source by a change in voltage output of said photovoltaic device;

means connected to said leads for detecting said voltage output change; and means for responding in a predetermined manner to said change.

27. A monitoring system including said light-responsive device according to claim 25 and a controller device connected to said leads which compares a signal from said light-responsive device with a predetermined normal signal range and, in the event of a deviation from said normal range, activates a telephone warning to an operator and control relays in response to said deviation.

28. A light-responsive device comprising:

(a) a plurality of laminae of a resilient foam material adhered together to form a housing having first and second opposed surfaces, each lamina having a centrally located hole such that the housing has an internal recess extending from the first surface to the opposed second surface, the second surface being covered by a transparent, colored first cover sheet having a printed pattern over the opening communicating with the recess so as to limit access of light therethrough, and the first surface being covered by a transparent second cover sheet;

(b) a photovoltaic device located in the recess within the housing and responsive to light, from a light source, reaching it through the light access port, generating an electric current proportional to the light intensity;

(c) leads for conducting said current from the photovoltaic device; and (d) a double-sided adhesive strip adhered to the second transparent cover sheet and having an aperture permitting access of light to the photovoltaic device.

29. A device according to claim 28 in which the second cover sheet is a transparent, plastic, double-sided adhesive strip and component recited in subparagraph (d) is omitted.

30. A monitoring system which comprises:

the light-responsive device according to claim 28 for registering activation or deactivation of the light source by a change in voltage output of said photovoltaic device;

means connected to said leads for detecting said voltage output change; and means for responding in a predetermined manner said change.

31. A monitoring system including said light-responsive device according to claim 28 and a controller device connected to said leads which compares a signal from said light-responsive device with a predetermined normal signal range and, in the event of a deviation from said normal range, activates a telephone warning to an operator and control relays in response to said deviation.

32. A warning system incorporating a light-responsive device comprising:

a housing having a first surface and a light access port in said first surface communicating with a recess within the housing;

a photovoltaic device located within said recess;

adhesive on said first surface of said housing attaching said housing to a receiving surface surrounding a light source, a light-tight connection being established between said housing and said receiving surface when said housing is so attached, said housing providing a substantially opaque enclosure that permits no significant access of ambient light to the photovoltaic device; and an observation port in an exterior surface of said housing connected by a light-path to said light access port which allows observation from outside said housing of on/off status of the light source;

means for registering a change in the on/off status of said light source, activated by a change of voltage output from the photovoltaic device.

33. A monitoring system which comprises:

the warning system according to claim 32; and means for responding in a predetermined manner to said change.

34. A warning system according to claim 32 in which the means for registering a change in the on/off status of a light source is a controller device which compares the signal generated by the light-responsive device with a normal signal range and, in the event of said deviation from said normal range, activates a telephone warning to an operator and control relays in response to said deviation.

35. A light-responsive device comprising:

a housing having first and second surfaces and a light access port in the first surface communicating with a recess within the housing;

a photovoltaic device located within said recess;

means for attaching the first surface of said housing to a receiving surface surrounding a light source;

said housing providing a substantially opaque enclosure that permits no significant access of ambient light to the photovoltaic device through said housing when the housing is attached to such a receiving surface; and an observation port in said housing for visually monitoring on/off status of said light source.

* * * * *

UNITED STATES PATENT AND TRADEMARK OFFICE

CERTIFICATE OF CORRECTION

PATENT NO. : 4,990,896

DATED : February 5, 1991

INVENTOR(S) : William F. Gray

It is certified that error appears in the above-identified patent and that said Letters Patent is hereby corrected as shown below:

Column 10, line 10, after "receiving" insert --surface; and--.

Signed and Sealed this

Seventeenth Day of November, 1992

*Attest:*

DOUGLAS B. COMER

*Attesting Officer*

*Acting Commissioner of Patents and Trademarks*